US009318037B2

(12) United States Patent
Zhang et al.

(10) Patent No.: US 9,318,037 B2
(45) Date of Patent: Apr. 19, 2016

(54) APPARATUS FOR ELIMINATING IMAGE STICKING, DISPLAY DEVICE AND METHOD FOR ELIMINATING IMAGE STICKING

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zhengxin Zhang, Beijing (CN); Shuai Xu, Beijing (CN); Yi Zheng, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/365,874

(22) PCT Filed: Jul. 9, 2013

(86) PCT No.: PCT/CN2013/079072

§ 371 (c)(1),
(2) Date: Jun. 16, 2014

(87) PCT Pub. No.: WO2014/161241

PCT Pub. Date: Oct. 9, 2014

(65) Prior Publication Data

US 2015/0154900 A1 Jun. 4, 2015

(30) Foreign Application Priority Data

Apr. 2, 2013 (CN) ..... 2013 1 0113009

(51) Int. Cl.
*G09G 3/20* (2006.01)

(52) U.S. Cl.
CPC ..... *G09G 3/20* (2013.01); *G09G 2310/0243* (2013.01); *G09G 2310/0264* (2013.01); *G09G 2310/0267* (2013.01); *G09G 2320/0257* (2013.01)

(58) Field of Classification Search
CPC ..... G09G 3/20; G09G 2320/0257; G09G 2310/0243; G09G 2310/0264
USPC ..... 345/1.1
See application file for complete search history.

(56) References Cited

U.S. PATENT DOCUMENTS

2005/0062706 A1 3/2005 Mizumaki
2008/0291189 A1 11/2008 Song et al.
(Continued)

FOREIGN PATENT DOCUMENTS

CN 10334973 A 12/2008
CN 101398550 A 4/2009
(Continued)

OTHER PUBLICATIONS

Written Opinion of the International Searching Authority dated Jan. 2, 2014; PCT/CN2013/079072.
(Continued)

*Primary Examiner* — Sahlu Okebato
(74) *Attorney, Agent, or Firm* — Ladas & Parry LLP

(57) ABSTRACT

An apparatus for eliminating image sticking, a display device and a method for eliminating image sticking. The apparatus for eliminating image sticking comprises a Multi-Level Gate (MLG) circuit (1) and a gate driving module (2), the MLG circuit (1) is configured to receive a gate ON voltage unmodulated and output a modulated gate ON voltage according to an enable signal; the gate driving module (2) receives the gate ON voltage unmodulated and the modulated gate ON voltage outputted from the MLG circuit, and outputs one of the gate ON voltage unmodulated and the modulated gate ON voltage for each layer of gate lines among different layers of gate lines. No change in process on a panel side is required and a short period of time is taken to eliminate the image sticking. The image sticking eliminating effect is controllable because a gate signal and its falling time are controllable, and the image sticking eliminating is more flexible.

14 Claims, 6 Drawing Sheets

(56) References Cited

U.S. PATENT DOCUMENTS

| | | | | |
|---|---|---|---|---|
| 2008/0316161 | A1 | 12/2008 | Song et al. | |
| 2009/0079724 | A1 | 3/2009 | Dou | |
| 2009/0256832 | A1* | 10/2009 | Ding | 345/211 |
| 2011/0157123 | A1 | 6/2011 | Cho | |
| 2012/0169951 | A1 | 7/2012 | Sung et al. | |

FOREIGN PATENT DOCUMENTS

| | | | |
|---|---|---|---|
| CN | 101561601 | A | 10/2009 |
| CN | 102110405 | A | 6/2011 |
| JP | 06110035 | A | 4/1994 |
| KR | 20050028842 | A | 3/2005 |
| KR | 20070117360 | A | 12/2007 |
| KR | 20080103729 | A | 11/2008 |
| KR | 20090031971 | A | 3/2009 |

OTHER PUBLICATIONS

First Chinese Office Action dated Jan. 22, 2016; Appln. No. 201310113009.9.

* cited by examiner

APPARATUS FOR ELIMINATING IMAGE STICKING, DISPLAY DEVICE AND METHOD FOR ELIMINATING IMAGE STICKING

TECHNICAL FIELD

The present disclosure relates to the field of display, and more particularly to an apparatus for eliminating image sticking, a display device and a method for eliminating image sticking.

BACKGROUND

Currently, in order to realize a narrow bezel, a Half-size Video Graphics Array (HVGA) product utilizes a dual-layer wirings design generally, as illustrated in FIG. 1. Gate signal lines such as G1, G3, G5, G7, G9, and so forth communicate via metal in a gate layer while gate signal lines such as G2, G4, G6, G8, and so forth communicate via metal in a source/drain layer. In the case of dual-layer wirings, a resistance difference between the two layers of metal is large, and a delay difference between gate signals from the gate layer and the source/drain layer in the two layers of metal is great due to factors such as a difference in film homogeneity and the like. Especially at a rear-end of a panel which is far away from an integrated circuit, such delay of the gate signals would affect a feed-through voltage $\Delta Vp$, which may affect a pixel voltage and in turn generate voltage difference, such that light and dark image sticking occurs for a gray scale picture. Regarding this problem, at present, the only way is to change the process on the panel side, however the verifying period for such change is long, and it is still possible that the change in the process might further worsen the above problem.

SUMMARY

In view of this, a major object of the present disclosure is to provide an apparatus for eliminating image sticking, a display device and a method for eliminating image sticking, which require no change in process on a panel side and take a short period of time to eliminate the image sticking. In addition, the image sticking eliminating effect is controllable because a gate signal and its falling time are controllable, and thus the image sticking eliminating is more flexible.

According to an embodiment of the present disclosure, there is provided an apparatus for eliminating image sticking comprising: a Multi-Level Gate (MLG) circuit and a gate driving module. The MLG circuit is configured to receive a gate ON voltage unmodulated and output a modulated gate ON voltage according to an enable signal. The gate driving module is configured to receive the gate ON voltage unmodulated and the modulated gate ON voltage outputted from the MLG circuit, and outputs one of the gate ON voltage unmodulated and the modulated gate ON voltage for each layer of gate lines among different layers of gate lines.

In an example, the gate driving module comprises a switch module and a gate signal generation module, the switch module comprises a plurality of sub switch modules, the gate signal generation module comprises a plurality of sub gate signal generation modules. For each layer of gate lines among the different layers of gate lines, there are one sub switch module among the plurality of the sub switch modules and one sub gate signal generation module of the plurality of the sub gate signal generation modules corresponding thereto. Each of the sub switch modules is configured to select and output one of the modulated gate ON voltage and the gate ON voltage unmodulated. Each of the sub gate signal generation modules is connected with its corresponding sub switch module and is configured to provide the gate ON voltage selected and outputted from its corresponding sub switch module to a corresponding layer of gate lines among the different layers of gate lines.

According to another embodiment of the present disclosure, there is further provided a display device comprising the apparatus for eliminating image sticking described above.

According to a further embodiment of the present disclosure, there is also provided a method for eliminating image sticking, comprising: receiving, by a Multi-Level Gate (MLG) circuit, a gate ON voltage unmodulated and outputting a modulated gate ON voltage according to an enable signal; receiving, by a gate driving module, the gate ON voltage unmodulated and the modulated gate ON voltage outputted from the MLG circuit, and outputting one of the gate ON voltage unmodulated and the modulated gate ON voltage for each layer of gate lines among different layers of gate lines.

The apparatus for eliminating image sticking, the display device and the method for eliminating image sticking according to the embodiments of the present disclosure require no change in process on the panel side and take a short period of time to eliminate the image sticking. In addition, the image sticking eliminating effect is controllable since a gate signal and its falling time are controllable, and thus the image sticking eliminating is more flexible.

DETAILED DESCRIPTION

Thereafter, solutions of embodiments of the present disclosure will be described clearly and completely in connection with drawings of the embodiments of the present disclosure, but obviously the described embodiments are only some, but not all of the embodiments of the present disclosure. Any other embodiments obtained by those ordinary skilled in the art based on the embodiments of the present disclosure without inventive labors should fall into a scope sought for protection in the present disclosure.

Figure 2:
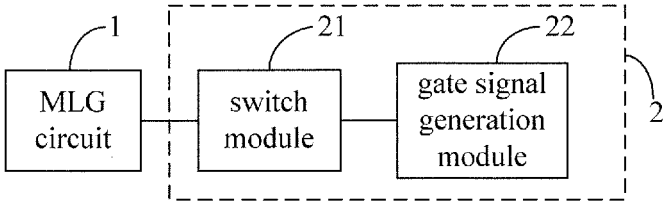
FIG. 2 is an exemplary diagram illustrating an apparatus for eliminating image sticking according to the embodiments of the present disclosure.

In order to settle a problem that light and dark image sticking occurs for a gray scale picture, in embodiments of the present disclosure, there is provided an apparatus for eliminating image sticking. As illustrated in FIG. 2, the apparatus for eliminating image sticking comprises: a Multi-Level Gate (MLG) circuit 1 and a gate driving module 2. The MLG circuit 1 is configured to output a modulated gate ON voltage according to an enable signal; the gate driving module 2 receives a gate ON voltage unmodulated and the modulated gate ON voltage outputted from the MLG circuit 1, and outputs them to different layers of gate lines.

As illustrated in FIG. 2, the gate driving module 2 comprises a switch module 21 and a gate signal generation module 22.

In an example, the switch module 21 comprises a plurality of sub switch modules, each of the sub switch modules is configured to receive the modulated gate ON voltage from an output terminal of the MLG circuit 1, receive the gate ON voltage unmodulated, and select and output the modulated gate ON voltage and or the gate ON voltage unmodulated.

The gate signal generation module 22 comprises a plurality of sub gate signal generation modules, and each of the sub gate signal generation modules is connected with its corresponding sub switch module in the switch module 21. The plurality of sub gate signal generation modules are configured to provide the gate ON voltages selected and outputted from the corresponding sub switch modules to the gate lines located in the different layers.

For each layer of gate lines among the different layers of gate lines, there are one sub switch module among the plurality of the sub switch modules and one sub gate signal generation module among the plurality of the sub gate signal generation modules corresponding thereto.

The apparatus for eliminating the image sticking according to the embodiments of the present disclosure may utilize the gate signal modulation to change falling times of the gate signals loaded to the different layers, that is, to control the falling times of the gate signals loaded to the different layers, so that delay differences exist in the outputs of the gate signals loaded to the different layers, and the delay differences are also adjustable. The image sticking to be eliminated in the embodiments of the present disclosure is not limited to light and dark strips, but can be the image sticking which could be eliminated by the apparatus according to the embodiments of the present disclosure.

Figure 3:
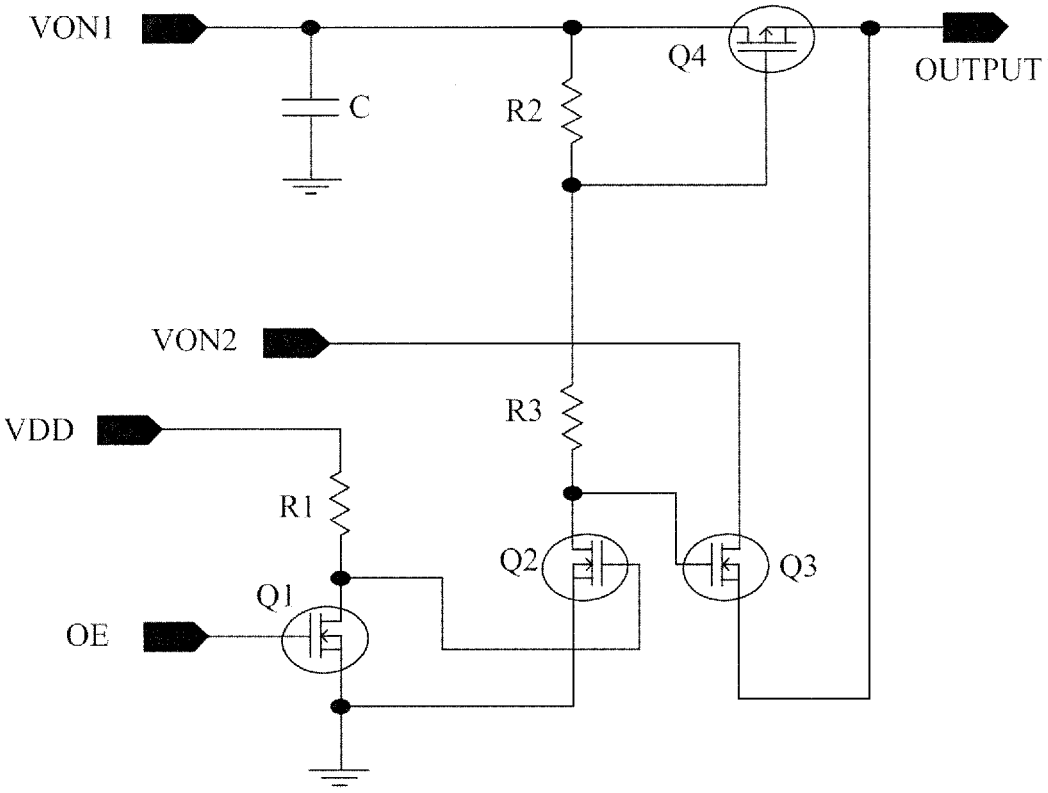
FIG. 3 is a diagram illustrating a structure of a Multi-Level Gate (MLC) circuit according to the embodiments of the present disclosure.

As illustrated in FIG. 3, the MLG circuit 1 comprises a first switching transistor Q1, a second switching transistor Q2, a third switching transistor Q3, a fourth switching transistor Q4, a first resistor R1, a second resistor R2 and a third resistor R3.

A gate of the first switching transistor Q1 receives an enable signal OE, and a drain thereof is connected with a gate of the second switching transistor Q2. The first resistor R1 is connected between a power supply voltage VDD and the drain of the first switching transistor Q1 in series, and functions to prevent the power supply from being connected with ground directly when the Q1 is turned on.

A drain of the second switching transistor Q2 is connected with a gate of the third switching transistor Q3; a drain of the third switching transistor Q3 is connected with a second gate ON voltage VON2. A source of the first switching transistor Q1 and a source of the second switching transistor Q2 are connected with a common voltage terminal.

A gate of the fourth switching transistor Q4 is connected with a divisional voltage of a first gate ON voltage VON1, a drain of the fourth switching transistor Q4 is connected with the first gate ON voltage VON1, and a connection node between a source of the third switching transistor Q3 and a source of the fourth switching transistor Q4 functions as an output of the MLG circuit 1.

The second resistor R2 is connected between the first gate ON voltage VON1 and the gate of the fourth switching transistor Q4, and functions to determine and adjust a bias voltage at the gate of the Q4. If the R2 does not exist, the Q4 can not be turned off.

The third resistor R3 is connected between the gate of the fourth switching transistor Q4 and the drain of the second switching transistor Q2, and functions to make the bias voltage of the Q4 being smaller than the VON1.

In an example, the first gate ON voltage VON1 is a gate ON voltage unmodulated, namely a normal gate ON voltage, and the second gate ON voltage VON2 is smaller than the first gate ON voltage VON1, and in particular a difference value between the VON1 and the VON2 may be set depending on requirements for the falling times of the gate signals. Optionally, a capacitor C may be configured between input terminal of the first gate ON voltage VON1 and the ground and/or between input terminal of the second gate ON voltage VON2 and the ground to perform noise reducing and filtering functions, so as to eliminate an effect on the circuit caused by an AC (alternating-current) signal in the input voltage. As an example, in FIG. 3, the capacitor C is only disposed at the input terminal of the first gate ON voltage.

Figure 4:
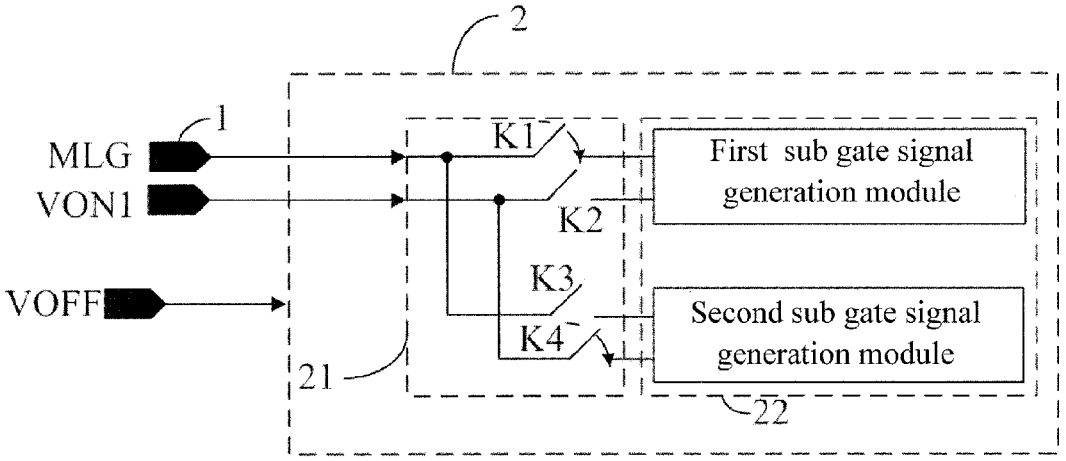
FIG. 4 is an exemplary diagram illustrating an apparatus for eliminating the image sticking according to the embodiments of the present disclosure.

More particularly, as illustrated in FIG. 4, the switch module 21 comprises a first sub switch module and a second sub switch module. The first sub switch module comprises a first switch K1 and a second switch K2, while the second sub switch module comprises a third switch K3 and a fourth switch K4. The plurality of the sub gate signal generation modules comprise a first sub gate signal generation module GM1 and a second sub gate signal generation module GM2.

The first switch K1 is connected between the output terminal of the MLG circuit and the first sub gate signal generation module GM1; the second switch K2 is connected between the first gate ON voltage VON1 unmodulated and the first sub gate signal generation module GM1; the third switch K3 is connected between the output terminal of the MLG circuit and the second sub gate signal generation module GM2; and the fourth switch K4 is connected between the first gate ON voltage VON1 unmodulated and the second sub gate signal generation module GM2.

In an example, the gate signal generation module 22 comprises a plurality of gate lines, and the gate lines for the first sub gate signal generation module GM1 and the gate lines for the second sub gate signal generation module GM2 locate in different metal layers.

Figure 1:
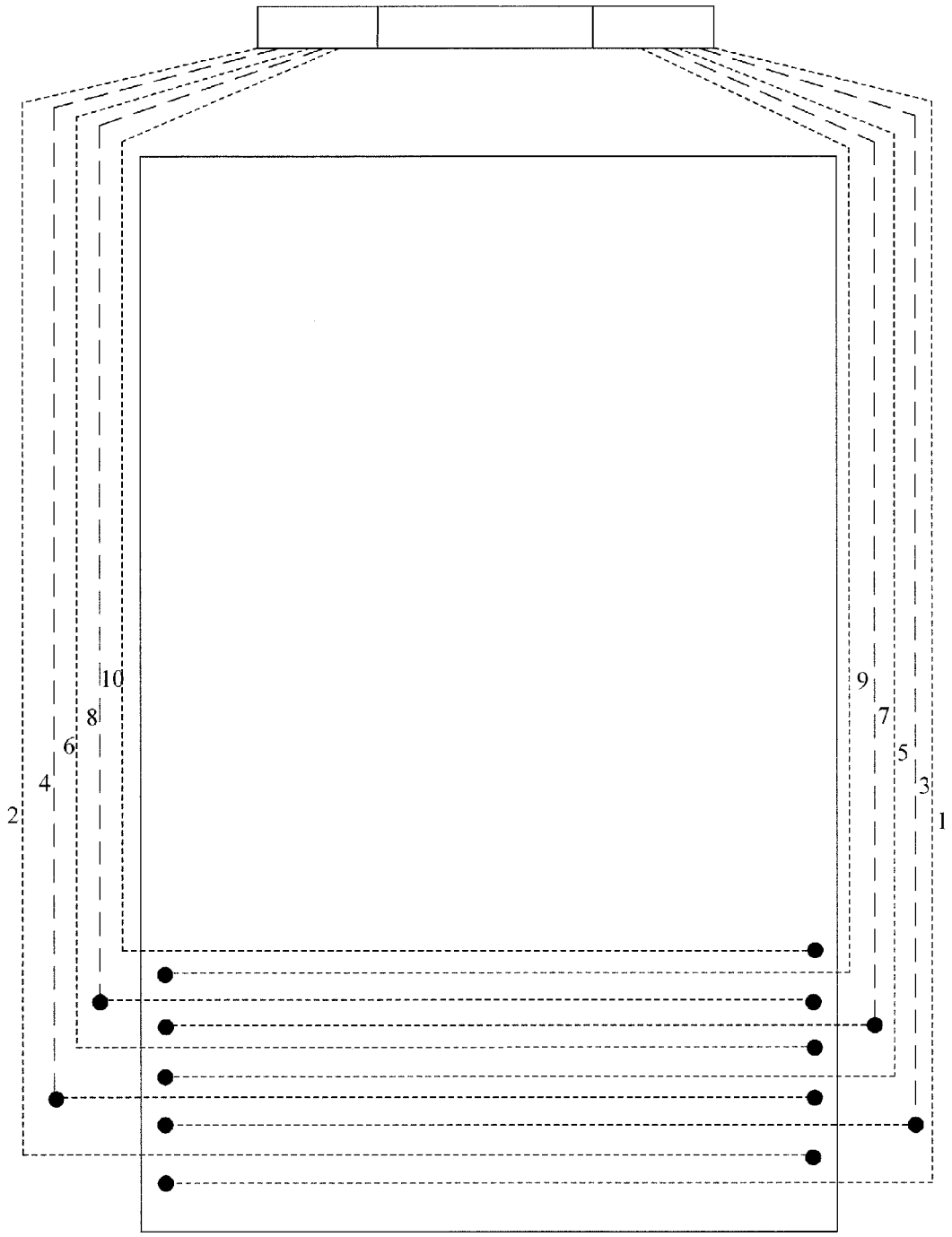
FIG. 1 is an exemplary diagram illustrating outputting of gate signals in a dual-side driving manner according to embodiments of the present disclosure.

In the manner of the dual-layer wirings shown in FIG. 1, G1, G3, G5, G7, G9, and so forth utilize the gate signal lines transmitted by metals in the gate layer and correspond to the first sub gate signal generation module GM1, while G2, G4, G6, G8, and so forth utilize the gate signal lines transmitted by metals in the source/drain layer and correspond to the second sub gate signal generation module GM2, and the different sub gate signal generation modules correspond to the different metal layers.

Figure 5:
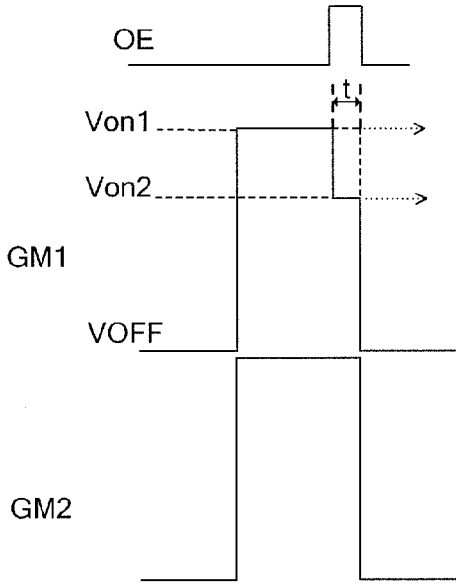
FIG. 5 is an exemplary chart illustrating waveforms generated when the gate signal is delayed and modulated according to the embodiments of the present disclosure.

A method for modulating the falling time of the gate signals will be described below in connection with reference to FIGS. 3-5, the MLG circuit 1 illustrated in FIG. 3 may be applied to modulate and output different gate ON voltages according to the enable signal OE so as to modulate the falling time of the outputted gate signal. As illustrated in FIG. 3, the first to third switching transistors Q1-Q3 are N-mos transistors, while the fourth switching transistor Q4 is a P-mos transistor.

When the enable signal OE is at a high level, the gate of the first switching transistor Q1 is at the high level, the first switching transistor Q1 is turned on. Then, the gate of the second switching transistor Q2 is at a low level, the second switching transistor Q2 is turned off, and the drain of the second switching transistor Q is at the high level. The third switching transistor Q3 is the N-mos transistor, its gate is connected with the drain of the second switching transistor Q2 and receives the first gate ON voltage VON1 through the second resistor R2 and the third resistor R3. Since the VON1 is connected with the gate of the third switching transistor Q3 through the second resistor R2 and the third resistor R3, and since the second switching transistor Q2 is turned off, no current flows through the second resistor R2 and the third resistor R3 and no voltage drop exists on the second resistor R2 and the third resistor R3, so that a voltage at the gate of the third switching transistor Q3 is equal to the first gate ON voltage VON1, and the drain of the third switching transistor Q3 receives the second gate ON voltage VON2, the third switching transistor Q3 is turned on. The fourth switching transistor Q4 is the P-mos transistor, its gate is connected between the second resistor R2 and the third resistor R3. Since no voltage drop exists on the second resistor R2 and the third resistor R3, a voltage at the gate of the fourth switching transistor Q4 is equal to the first gate ON voltage VON1, and a voltage at the drain of the fourth switching transistor Q4 is the first gate ON voltage VON1, the fourth switching transistor Q4 is turned off. Since the third switching transistor Q3 is turned on and the fourth switching transistor Q4 is turned off, the MLG circuit 1 outputs VON2.

When the OE is at the low level, the gate of the first switching transistor Q1 is at the low level, the first switching transistor Q is turned off. Then, the gate of the second switching transistor Q2 is at the high level, the second switching transistor Q2 is turned on, and the drain of the second switching transistor Q2 is at the low level. The third switching transistor Q3 is the N-mos transistor, the gate of the third switching transistor is grounded and is at the low level, the first gate ON voltage VON1 is divided through the second resistor R2 and the third resistor R3, then the third switching transistor is turned off. The fourth switching transistor Q4 is the P-mos transistor, the voltage at the gate of the fourth switching transistor Q4 is decided by the voltage division of the second resistor R2 and the third resistor R3, and the fourth switching transistor Q4 is turned on. Since the third switching transistor Q3 is turned off and the fourth switching transistor Q4 is turned on, the MLG circuit 1 outputs VON1.

A plurality of the gate ON voltages may be outputted by the MLG circuit 1, a degree of dropping of the gate ON voltage may be adjusted by selecting a value of the VON2 voltage, and the falling time of the gate ON voltage may be adjusted by adjusting a duty ratio of the OE signal. When the OE is at the low level, the MLG circuit outputs the VON1; and when the OE is at the high level, the MLG circuit outputs the VON2, VON1>VON2, thus realizing the modulation of the gate signal.

The gate ON voltage VON1 outputted normally, the gate ON voltage modulated according to the OE and outputted from the MLG circuit 1 and a gate OFF signal VOFF are provided to the gate driving module 2. The modulation of the gate signal is realized by controlling whether to load the multi-level gate signal by the switch module 21, so that the falling times of the gate signals loaded to the different layers are controlled and the delay differences are realized in the gate signals loaded to the different layers, the generated waveforms are as illustrated in FIG. 5.

In FIG. 4, the switch module 21 is composed of the first switch K1, the second switch K2, the third switch K3 and the fourth switch K4. The switch module 21 receives the modulated gate ON voltage outputted from the output terminal of the MLG circuit 1 and further receives the first gate ON voltage VON1, and the switch module 21 can select and output the modulated gate ON voltage from the MLG circuit 1 or the first gate ON voltage VON1 unmodulated.

It can be seen from FIG. 4 that the plurality of sub gate signal generation modules included in the gate signal generation module 22 are connected with the corresponding sub switch modules in the switch module 21 respectively, and the gate signal generation module can provide the gate signal selected and outputted by the switch module 21 to the gate lines located in the different layers. More particularly, the first sub gate signal generation module GM1 may be used to generate the gate signals for the G1, G3, G5, G7, G9, and so forth among the gate signals, while the second sub gate signal generation module GM2 may be used to generate the gate signals for the G2, G4, G6, G8, and so forth among the gate signals. Both of the first sub gate signal generation module GM1 and the second sub gate signal generation module GM2 can receive the multi-level gate output signal, the VON1 and the VOFF generated by a front end circuit.

Figure 6A:
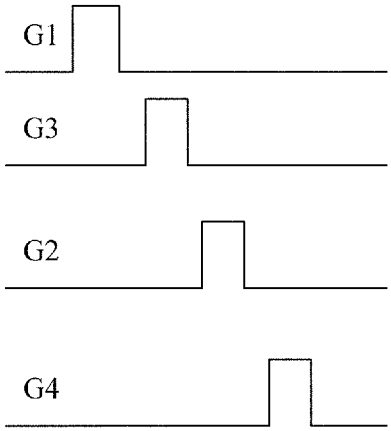
FIGS. 6*a*-6*c* are exemplary charts illustrating output waveforms of gate signals in the prior art and output waveforms of gate signals according to the embodiments of the present disclosure.
Figure 6B:
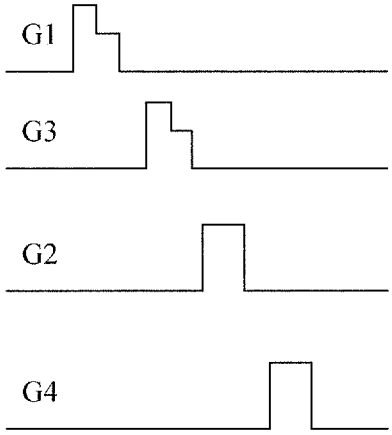
Figure 6C:
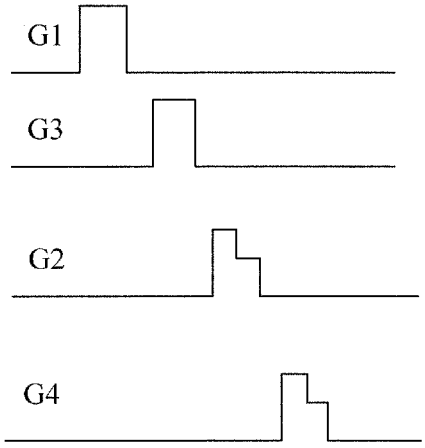

In a traditional design, the output waveforms of the gate signals generated by the first sub gate signal generation module GM1 are as same as those of the gate signals generated by the second sub gate signal generation module GM2, as illustrated in FIG. 6*a*. In the embodiments of the present disclosure, the output waveforms of the gate signals generated by the first sub gate signal generation module GM1 may be different from those of the gate signals generated by the second sub gate signal generation module GM2, as illustrated in FIG. 6*b*, the gate signals such as G1, G3, and so forth generated by the first sub gate signal generation module GM1 have been modulated while the gate signals such as G2, G4, and so forth generated by the second sub gate signal generation module GM2 are unchanged. Alternatively, as illustrated in FIG. 6*c*, the gate signals such as G2, G4, and so forth generated by the second sub gate signal generation module GM2 have been modulated while the gate signals such as G1, G3, and so forth generated by the first sub gate signal generation module GM1 are unchanged.

In FIG. 4, if the first switch K1 and the third switch K3 are opened, and the second switch K2 and the fourth switch K4 are closed, both of the first sub gate signal generation module GM1 and the second sub gate signal generation module GM2 only receive the VON1 and VOFF, and at this time, all of G1~GN output the same first gate ON voltage VON1 unmodulated.

In FIG. 4, if the second switch K2 and the third switch K3 are opened while the first switch K1 and the fourth switch K4 are closed, the first sub gate signal generation module GM1 receives a MLG output signal and the VOFF, and the second sub gate signal generation module GM2 receives the VON1 and VOFF. At this time, the gate signals such as G1, G3, G5, G7, G9, and so forth generated by the first sub gate signal generation module GM1 have been modulated while the gate signals such as G2, G4, G6, G8, and so forth generated by the second sub gate signal generation module GM2 are still unmodulated.

Similarly, in FIG. 4, if the first switch K1 and the fourth switch K4 are opened while the second switch K2 and the third switch K3 are closed, the signals generated by the first sub gate signal generation module GM1 are the first gate ON voltage VON1 unmodulated and the signals generated by the second sub gate signal generation module GM2 have been modulated.

In an actual application, the delays in the gate signals at the rear-ends of the gate layer and the source-drain layer are uncertain, sometimes the delay in the gate signal at the rear-end of the gate layer is greater than that in the gate signal at the rear-end of the source-drain layer, but sometimes the delay in the gate signal at the rear-end of the gate layer is smaller than that in the gate signal at the rear-end of the source/drain layer, and a difference between the delays is also uncertain.

Figure 7:
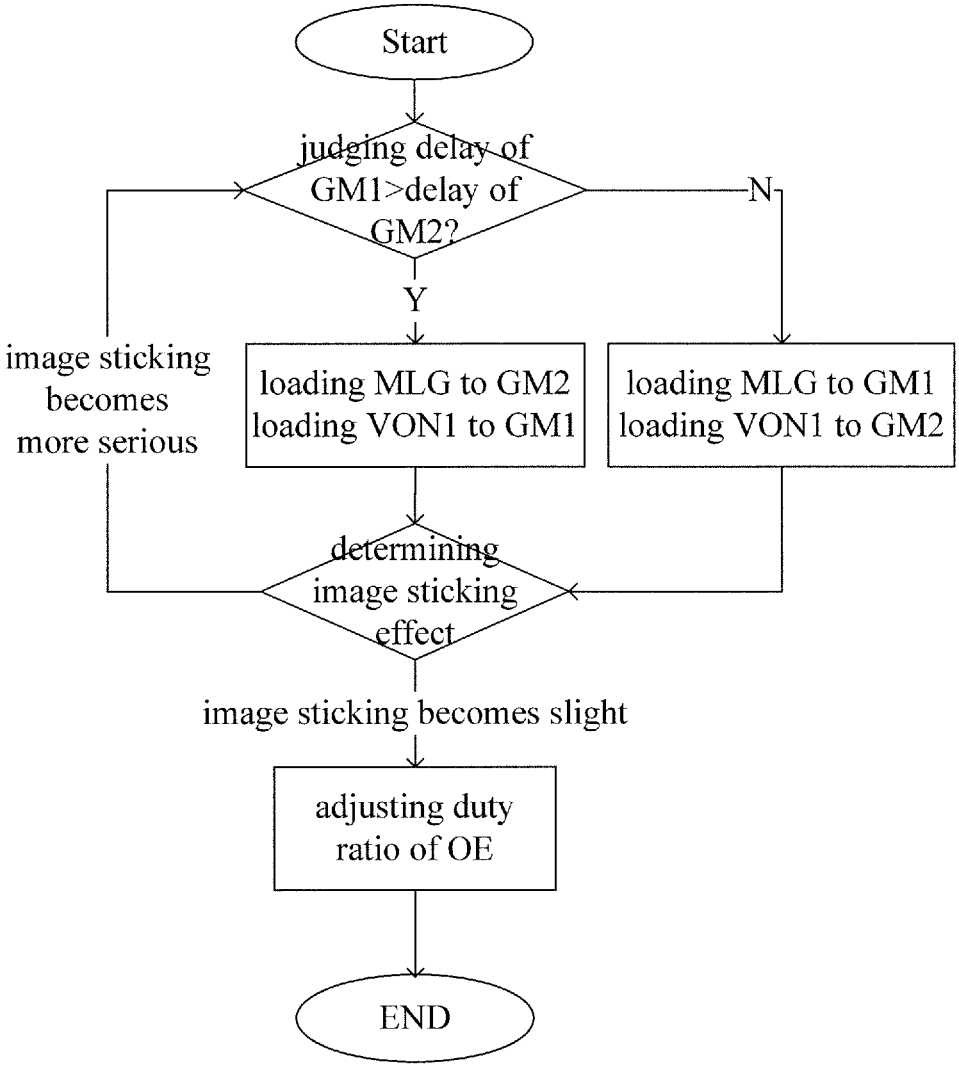
FIG. 7 is a flowchart for eliminating image sticking according to an embodiment of the present disclosure.

In order to know of which layer the delay in the gate signal at the rear-end is greater, a waveform of the signal at the rear-end may be detected. Generally, only operations shown in FIG. 7 are needed to be performed in an actual test.

At first, it is assumed that the delay of the first sub gate signal generation module GM1 is greater than that of the second sub gate signal generation module GM2, the MLG output signal is loaded to the second sub gate signal generation module GM2 and the first gate ON voltage VON1 is loaded to the first sub gate signal generation module GM1, and then an effect of the image sticking in the display is determined. If the image sticking becomes more serious, it may be determined that the delay of the second sub gate signal generation module GM2 is greater than that of the first sub gate signal generation module GM1 and then the MLG output signal is loaded to the first sub gate signal generation module GM1 and the first gate ON voltage VON1 is loaded to the second sub gate signal generation module GM2, and then the effect of the image sticking in the display is determined. If the image sticking is eliminated, the modulation of the gate signals may be terminated, and if the image sticking still exists but is mitigated, the duty ratio of the enable signal OE may be adjusted finely according to the display effect on this basis.

Alternatively, if the MLG output signal is loaded to the second sub gate signal generation module GM2 and the first gate ON voltage VON1 is loaded to the first sub gate signal generation module GM1, and then an effect of the image sticking in the display is determined. If the image sticking is mitigated, it may be determined that the delay of the first sub gate signal generation module GM1 is greater than that of the second sub gate signal generation module GM2, and the MLG output signal is loaded to the second sub gate signal generation module GM2 continually and the first gate ON voltage VON1 is loaded to the first sub gate signal generation module GM1 continually, and then the duty ratio of the enable signal OE may be adjusted finely according to the display effect on this basis.

Figure 8:
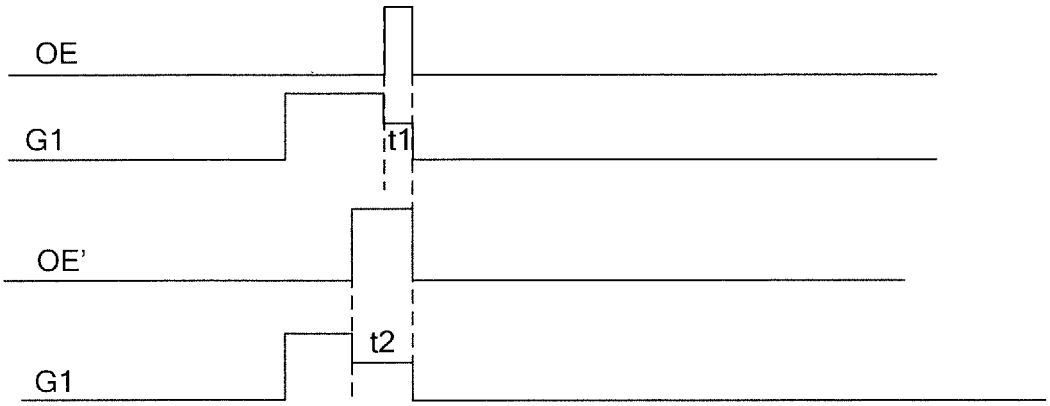
FIG. 8 is an exemplary chart illustrating waveforms used for image sticking eliminating according to another embodiment of the present disclosure.

When performing modulation to make the image sticking slight, a waveform of an original output signal may be adjusted finely by a chip so as to compensate delays caused by wirings on the panel. For example, a width of the second gate ON voltage is modulated by changing the duty ratio of the OE, so that the falling time of the gate signal is adjusted finely. As illustrated in FIG. 8, the OE signal controls the width of the second gate ON voltage, among the gate ON voltages, to be t1, and the OE' signal controls the width of the second gate ON voltage, among the gate ON voltages, to be t2. The detailed width may be set depending on the requirements and the degree of dropping of the gate ON voltage may also be set depending on the requirements.

It should be noted that a case of dual-layer wirings is described in the above embodiments, and if there is a case in which multi-layer wirings more than the dual-layer wirings is adopted, its detailed processing manner is similar to the manner described above and a difference is only in that more than two sub gate signal generation modules are required and the gate signals of more than two layers are needed to be modulated.

According to the embodiments of the present disclosure, there is further provided a method for eliminating image sticking. In the method, a Multi-Level Gate (MLG) circuit outputs a modulated gate ON voltage according to an enable signal; a gate driving module receives a gate ON voltage unmodulated and the modulated gate ON voltage outputted from the MLG circuit, and outputs one of the gate ON voltage unmodulated and the modulated gate ON voltage for each layer of gate lines among different layers of gate lines.

Figure 9:
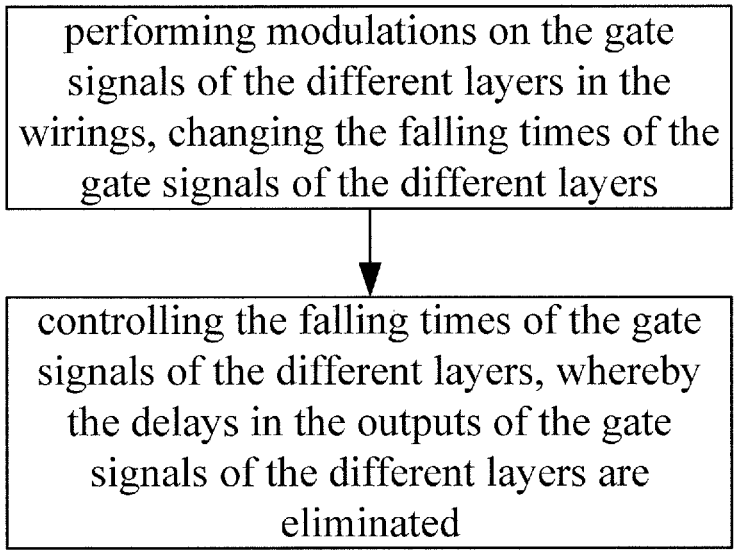
FIG. 9 is a brief flowchart for eliminating image sticking according to the embodiments of the present disclosure.

In an example, for the gate lines in each layer, their corresponding sub switch module receives the gate ON voltage unmodulated and receives the modulated gate ON voltage from the output terminal of the MLG circuit, selects one of the gate ON voltage unmodulated and the modulated gate ON voltage, and provides the selected gate ON voltage to a corresponding sub gate signal generation module which then outputs the gate ON voltage received from the sub switch module. As being applied to the problem to be solved by the present disclosure, this method may be expressed as a flowchart illustrated in FIG. 9 and the flowchart comprises steps as follows: performing modulations on the gate signals of the different layers in the wirings, changing the falling times of the gate signals of the different layers; and controlling the falling times of the gate signals of the different layers, whereby the delays in the outputs of the gate signals of the different layers are eliminated.

According to the embodiments of the present disclosure, there is further provided a display device comprising the apparatus for eliminating image sticking described above. The display device may be a liquid crystal panel, a electric paper, an OLED panel, a mobile phone, a tablet computer, a TV, a display, a notebook computer, a digital photo frame, a navigation machine or any other product or part having the display function.

In conclusion, the apparatus for eliminating image sticking, the display device and the method for eliminating image sticking according to the embodiments of the present disclosure require no change in process on a panel side and take a short period of time to eliminate the image sticking. In addition, the image sticking eliminating effect is controllable because a gate signal and its falling time are controllable, and thus the image sticking eliminating is more flexible.

The above descriptions only illustrate the specific embodiments of the present invention, and the protection scope of the present invention is not limited to this.

What is claimed is:

1. An apparatus for eliminating image sticking, comprising: a Multi-Level Gate MLG circuit and a gate driving module, the MLG circuit is configured to receive a gate ON voltage unmodulated and output a modulated gate ON voltage according to an enable signal;

the gate driving module receives the gate ON voltage unmodulated and the modulated gate ON voltage outputted from the MLG circuit, and outputs one of the gate ON voltage unmodulated and the modulated gate ON voltage for each layer of gate lines among different layers of gate lines.

2. The apparatus of claim 1, wherein the gate driving module comprises a switch module and a gate signal generation module, the switch module comprises a plurality of sub switch modules, the gate signal generation module comprises a plurality of sub gate signal generation modules;

for each layer of gate lines among the different layers of gate lines, there are one sub switch module of the plurality of the sub switch modules corresponds thereto and one sub gate signal generation module of the plurality of the sub gate signal generation module corresponding thereto, each of the sub switch module is configured to select and output one of the modulated gate ON voltage and the gate ON voltage unmodulated; and each sub gate signal generation module is connected with its corresponding sub switch module and is configured to provide the gate ON voltage selected and outputted from the corresponding sub switch module to a corresponding layer of gate lines among the different layers of gate lines.

3. The apparatus of claim 2 wherein the MLG circuit comprises a first switching transistor, a second switching transistor, a third switching transistor, a fourth switching transistor, a first resistor, a second resistor and a third resistor; wherein a gate of the first switching transistor receives the enable signal, a drain thereof is connected with a gate of the second switching transistor;

the first resistor is connected between a power supply voltage and the drain of the first switching transistor in series;

a drain of the second switching transistor is connected with a gate of the third switching transistor;

a drain of the third switching transistor is connected with a second gate ON voltage;

a drain of the fourth switching transistor is connected with the first gate ON voltage, a gate of the fourth switching transistor is connected with the drain of the fourth switching transistor through the second resistor, and a connection node between a source of the third switching transistor and a source of the fourth switching transistor functions as an output of the MLG circuit;

the second resistor is connected between the first gate ON voltage and the gate of the fourth switching transistor in series; and the third resistor is connected between the gate of the fourth switching transistor and the drain of the second switching transistor in series.

4. The apparatus of claim 3, wherein the first to third switching transistors are N-mos transistors, and the fourth switching transistor is a P-mos transistor.

5. The apparatus of claim 2, wherein the switch module comprises a first sub switch module and a second sub switch module, the first sub switch module comprises a first switch and a second switch, while the second sub switch module comprises a third switch and a fourth switch, and the gate signal generation module comprises a first sub gate signal generation module and a second sub gate signal generation module; wherein the first switch is connected between the output terminal of the MLG circuit and the first sub gate signal generation module;

the second switch is connected between an input terminal of the gate ON voltage unmodulated and the first sub gate signal generation module;

the third switch is connected between an output terminal of the MLG circuit and the second sub gate signal generation module; and the fourth switch is connected between the input terminal of the gate ON voltage unmodulated and the second sub gate signal generation module.

6. The apparatus of claim 5, wherein gate ones for the first sub gate signal generation module and gate lines for the second sub gate signal generation module locate in different metal layers.

7. A display device comprising the apparatus for eliminating image sticking of claim 1.

8. The display device of claim 7, wherein the gate driving module comprises a switch module and a gate signal generation module, the switch module comprises a plurality of sub switch modules, the gate signal generation module comprises a plurality of sub gate signal generation modules;

for each layer of gate lines among the different layers of gate lines, there are one sub switch module of the plurality of the sub switch modules corresponds thereto and one sub gate signal generation module of the plurality of the sub gate signal generation module corresponding thereto, each of the sub switch module is configured to select and output one of the modulated gate ON voltage and the gate ON voltage unmodulated; and each sub gate signal generation module is connected with its corresponding sub switch module and is configured to provide the gate ON voltage selected and outputted from the corresponding sub switch module to a corresponding layer of gate lines among the different layers of gate lines.

9. The display device of claim 8, wherein the MLG circuit comprises a first switching transistor, a second switching transistor, a third switching transistor, a fourth switching transistor, a first resistor, a second resistor and a third resistor; wherein a gate of the first switching transistor receives the enable signal, a drain thereof is connected with a gate of the second switching transistor;

the first resistor is connected between a power supply voltage and the drain of the first switching transistor in series;

a drain of the second switching transistor is connected with a gate of the third switching transistor;

a drain of the third switching transistor is connected with a second gate ON voltage;

a drain of the fourth switching transistor is connected with the first gate ON voltage, a gate of the fourth switching transistor is connected with the drain of the fourth switching transistor through the second resistor, and a connection node between a source of the third switching transistor and a source of the fourth switching transistor functions as an output of the MLG circuit;

the second resistor is connected between the first gate ON voltage and the gate of the fourth switching transistor in series; and the third resistor is connected between the gate of the fourth switching transistor and the drain of the second switching transistor in series.

10. The display device of claim 9, wherein the first to third switching transistors are N-mos transistors, and the fourth switching transistor is a P-mos transistor.

11. The display device of claim 8, wherein the switch module comprises a first sub switch module and a second sub switch module, the first sub switch module comprises a first switch and a second switch, while the second sub switch module comprises a third switch and a fourth switch, and the gate signal generation module comprises a first sub gate signal generation module and a second sub gate signal generation module; wherein the first switch is connected between the output terminal of the MLG circuit and the first sub gate signal generation module;

the second switch is connected between an input terminal of the gate ON voltage unmodulated and the first sub gate signal generation module;

the third switch is connected between an output terminal of the MLG circuit and the second sub gate signal generation module; and the fourth switch is connected between the input terminal of the gate ON voltage unmodulated and the second sub gate signal generation module.

12. The display device of claim 8, wherein gate lines for the first sub gate signal generation module and gate lines for the second sub gate signal generation module locate in different metal layers.

13. A method for eliminating image sticking, comprising:

receiving, by a Multi-Level Gate MLG circuit, a gate ON voltage unmodulated and outputting a modulated gate ON voltage according to an enable signal;

receiving, by a gate driving module, the gate ON voltage unmodulated and the modulated gate ON voltage outputted from the MLG circuit, and outputting one of the gate ON voltage unmodulated and the modulated gate ON voltage for each layer of gate lines among different layers of gate lines.

14. The method of claim 13, wherein said outputting one of the gate ON voltage unmodulated and the modulated gate ON voltage for each layer of gate lines among different layers of gate lines comprises:

for each layer of gate lines among the different layers of gate lines, a sub switch module corresponding to the layer of gate lines selects one of the modulated gate ON voltage and the gate ON voltage unmodulated, and a sub gate signal generation module corresponding to the layer of gate lines provides the selected gate ON voltage to the layer of gate lines.

* * * * *